US008334506B2

(12) United States Patent
Rafferty

(10) Patent No.: US 8,334,506 B2
(45) Date of Patent: Dec. 18, 2012

(54) END CAP VOLTAGE CONTROL OF ION TRAPS

(75) Inventor: David Rafferty, Webster, TX (US)

(73) Assignee: 1st Detect Corporation, Austin, TX (US)

( * ) Notice: Subject to any disclaimer, the term of this patent is extended or adjusted under 35 U.S.C. 154(b) by 0 days.

(21) Appl. No.: 12/329,787

(22) Filed: Dec. 8, 2008

(65) Prior Publication Data

US 2009/0146054 A1 Jun. 11, 2009

Related U.S. Application Data

(60) Provisional application No. 61/012,660, filed on Dec. 10, 2007.

(51) Int. Cl.
*H01J 49/00* (2006.01)

(52) U.S. Cl. ..... 250/288; 250/281; 250/282

(58) Field of Classification Search ..... 250/281, 250/282, 290–292
See application file for complete search history.

(56) References Cited

U.S. PATENT DOCUMENTS

| | | | |
|---|---|---|---|
| 2,373,737 | A | 4/1945 | Artzt |
| 2,507,721 | A | 5/1950 | Law |
| 2,531,050 | A | 11/1950 | Huffer |
| 2,539,156 | A | 1/1951 | Ostreicher |
| 2,549,602 | A | 4/1951 | Hopps |
| 2,553,792 | A | 5/1951 | Smith et al. |
| 2,555,850 | A | 6/1951 | Glyptis |
| 2,575,067 | A | 11/1951 | Mucher |
| 2,580,355 | A | 12/1951 | Lempert |
| 2,582,402 | A | 1/1952 | Szegho |
| 2,604,533 | A | 7/1952 | Koros |
| 2,617,060 | A | 11/1952 | De Gier |
| 2,642,546 | A | 6/1953 | Patla |
| 2,661,436 | A | 12/1953 | Van Ormer |
| 2,663,815 | A | 12/1953 | Mucher |

(Continued)

FOREIGN PATENT DOCUMENTS

DE 10028914 C1 1/2002

(Continued)

OTHER PUBLICATIONS

"Mass Spectrometry," Wikipedia, the free encyclopedia, downloaded on Feb. 13, 2009 from http://en.wikipedia.org/w/index.php?title=Mass_spectrometry&printiable=yes; pp. 1-15.

(Continued)

*Primary Examiner* — Michael Maskell
(74) *Attorney, Agent, or Firm* — Fish & Richardson P.C.

(57) ABSTRACT

An ion trap for a mass spectrometer has a conductive central electrode with an aperture extending from a first open end to a second open end. A conductive first electrode end cap is disposed proximate to the first open end thereby forming a first intrinsic capacitance between the first end cap and the central electrode. A conductive second electrode end cap is disposed proximate to the second open end thereby forming a second intrinsic capacitance between the second end cap and the central electrode. A first circuit couples the second end cap to a reference potential. A signal source generating an AC trap signal is coupled to the central electrode. An excitation signal is impressed on the second end cap in response to a voltage division of the trap signal by the first intrinsic capacitance and the first circuit.

14 Claims, 4 Drawing Sheets

U.S. PATENT DOCUMENTS

| | | | | | |
|---|---|---|---|---|---|
| 2,756,392 | A | | 7/1956 | Donal, Jr. | |
| 2,810,091 | A | | 10/1957 | Harsh | |
| 2,903,612 | A | | 9/1959 | Van Ormer | |
| 2,921,212 | A | | 1/1960 | Berthold | |
| 2,939,952 | A | | 6/1960 | Paul et al. | |
| 2,974,253 | A | | 3/1961 | Jepsen | |
| 3,065,640 | A | | 11/1962 | Langmuir et al. | |
| 3,114,877 | A | | 12/1963 | Dunham | |
| 3,188,472 | A | | 6/1965 | Whipple, Jr. | |
| 3,307,332 | A | | 3/1967 | Grace et al. | |
| 3,526,583 | A | | 9/1970 | Hayward | |
| 3,631,280 | A | | 12/1971 | Levin et al. | |
| 4,075,533 | A | | 2/1978 | Janko | |
| 4,499,339 | A | | 2/1985 | Richard | |
| 4,540,884 | A | | 9/1985 | Stafford et al. | |
| 4,621,213 | A | | 11/1986 | Rand | |
| 4,650,999 | A | | 3/1987 | Fies, Jr. et al. | |
| 4,654,607 | A | | 3/1987 | Ishikawa | |
| 4,686,367 | A | | 8/1987 | Louris et al. | |
| 4,703,190 | A | * | 10/1987 | Tamura et al. | 307/2 |
| 4,736,101 | A | | 4/1988 | Syka et al. | |
| 4,743,794 | A | | 5/1988 | Van Den Broek et al. | |
| 4,746,802 | A | | 5/1988 | Kellerhals | |
| 4,749,860 | A | | 6/1988 | Kelley et al. | |
| 4,749,904 | A | | 6/1988 | Vasterink | |
| 4,755,670 | A | * | 7/1988 | Syka et al. | 250/292 |
| 4,761,545 | A | | 8/1988 | Marshall et al. | |
| 4,771,172 | A | | 9/1988 | Weber-Grabau et al. | |
| 4,818,869 | A | | 4/1989 | Weber-Grabau | |
| 4,867,939 | A | | 9/1989 | Deutch | |
| 4,924,089 | A | | 5/1990 | Caravatti | |
| 4,931,639 | A | | 6/1990 | McLafferty | |
| 4,945,234 | A | | 7/1990 | Goodman et al. | |
| 4,982,087 | A | | 1/1991 | Allemann et al. | |
| 4,982,088 | A | | 1/1991 | Weitekamp et al. | |
| 5,028,777 | A | | 7/1991 | Franzen et al. | |
| 5,051,582 | A | | 9/1991 | Bahns et al. | |
| 5,055,678 | A | | 10/1991 | Taylor et al. | |
| 5,075,547 | A | | 12/1991 | Johnson et al. | |
| 5,105,081 | A | | 4/1992 | Kelley | |
| 5,107,109 | A | | 4/1992 | Stafford, Jr. et al. | |
| 5,118,950 | A | | 6/1992 | Bahns et al. | |
| RE34,000 | E | | 7/1992 | Syka et al. | |
| 5,134,286 | A | | 7/1992 | Kelley | |
| 5,162,650 | A | | 11/1992 | Bier | |
| 5,171,991 | A | | 12/1992 | Johnson et al. | |
| 5,179,278 | A | | 1/1993 | Douglas | |
| 5,182,451 | A | | 1/1993 | Schwartz et al. | |
| 5,187,365 | A | | 2/1993 | Kelley | |
| 5,196,699 | A | | 3/1993 | Kelley | |
| 5,198,665 | A | | 3/1993 | Wells | |
| 5,200,613 | A | | 4/1993 | Kelley | |
| 5,206,509 | A | | 4/1993 | McLuckey et al. | |
| 5,248,882 | A | | 9/1993 | Liang | |
| 5,248,883 | A | | 9/1993 | Brewer et al. | |
| 5,256,875 | A | | 10/1993 | Hoekman et al. | |
| 5,272,337 | A | | 12/1993 | Thompson et al. | |
| 5,274,233 | A | | 12/1993 | Kelley | |
| 5,285,063 | A | | 2/1994 | Schwartz et al. | |
| 5,291,017 | A | | 3/1994 | Wang et al. | |
| 5,298,746 | A | | 3/1994 | Franzen et al. | |
| 5,302,826 | A | | 4/1994 | Wells | |
| 5,324,939 | A | | 6/1994 | Louris et al. | |
| 5,331,157 | A | | 7/1994 | Franzen | |
| 5,340,983 | A | | 8/1994 | Deinzer et al. | |
| 5,347,127 | A | | 9/1994 | Franzen | |
| 5,352,892 | A | | 10/1994 | Mordehai et al. | |
| 5,373,156 | A | | 12/1994 | Franzen | |
| 5,379,000 | A | | 1/1995 | Brewer et al. | |
| 5,381,007 | A | | 1/1995 | Kelley | |
| 5,385,624 | A | | 1/1995 | Amemiya et al. | |
| 5,386,113 | A | | 1/1995 | Franzen et al. | |
| 5,396,064 | A | | 3/1995 | Wells | |
| 5,399,857 | A | | 3/1995 | Doroshenko et al. | |
| 5,420,425 | A | | 5/1995 | Bier et al. | |
| 5,420,549 | A | | 5/1995 | Prestage | |
| 5,436,445 | A | | 7/1995 | Kelley et al. | |
| 5,436,446 | A | | 7/1995 | Jarrell et al. | |
| 5,438,195 | A | | 8/1995 | Franzen et al. | |
| 5,448,061 | A | | 9/1995 | Wells | |
| 5,448,062 | A | | 9/1995 | Cooks et al. | |
| 5,449,905 | A | | 9/1995 | Hoekman et al. | |
| 5,451,781 | A | | 9/1995 | Dietrich et al. | |
| 5,451,782 | A | | 9/1995 | Kelley | |
| 5,457,315 | A | | 10/1995 | Wells et al. | |
| 5,466,931 | A | | 11/1995 | Kelley | |
| 5,468,957 | A | | 11/1995 | Franzen | |
| 5,468,958 | A | * | 11/1995 | Franzen et al. | 250/292 |
| 5,475,227 | A | | 12/1995 | LaRue | |
| 5,479,012 | A | | 12/1995 | Wells | |
| 5,479,815 | A | | 1/1996 | White et al. | |
| 5,481,107 | A | | 1/1996 | Takada et al. | |
| 5,491,337 | A | | 2/1996 | Jenkins et al. | |
| 5,493,115 | A | | 2/1996 | Deinzer et al. | |
| 5,508,516 | A | | 4/1996 | Kelley | |
| 5,517,025 | A | | 5/1996 | Wells et al. | |
| 5,521,379 | A | | 5/1996 | Franzen et al. | |
| 5,521,380 | A | | 5/1996 | Wells et al. | |
| 5,527,731 | A | | 6/1996 | Yamamoto et al. | |
| 5,528,031 | A | | 6/1996 | Franzen | |
| 5,559,325 | A | | 9/1996 | Franzen | |
| 5,561,291 | A | | 10/1996 | Kelley et al. | |
| 5,569,917 | A | | 10/1996 | Buttrill, Jr. et al. | |
| 5,572,022 | A | | 11/1996 | Schwartz et al. | |
| 5,572,025 | A | | 11/1996 | Cotter et al. | |
| 5,572,035 | A | | 11/1996 | Franzen | |
| 5,608,216 | A | | 3/1997 | Wells et al. | |
| 5,608,217 | A | | 3/1997 | Franzen et al. | |
| 5,610,397 | A | | 3/1997 | Kelley | |
| 5,623,144 | A | | 4/1997 | Yoshinari et al. | |
| 5,625,186 | A | * | 4/1997 | Frankevich et al. | 250/292 |
| 5,633,497 | A | | 5/1997 | Brittain et al. | |
| 5,640,011 | A | | 6/1997 | Wells | |
| 5,644,131 | A | | 7/1997 | Hansen | |
| 5,650,617 | A | | 7/1997 | Mordehai | |
| 5,652,427 | A | | 7/1997 | Whitehouse et al. | |
| 5,654,542 | A | | 8/1997 | Schubert et al. | |
| 5,663,560 | A | | 9/1997 | Sakairi et al. | |
| 5,679,950 | A | | 10/1997 | Baba et al. | |
| 5,679,951 | A | | 10/1997 | Kelley et al. | |
| 5,693,941 | A | | 12/1997 | Barlow et al. | |
| 5,696,376 | A | | 12/1997 | Doroshenko et al. | |
| 5,708,268 | A | | 1/1998 | Franzen | |
| 5,710,427 | A | | 1/1998 | Schubert et al. | |
| 5,714,755 | A | * | 2/1998 | Wells et al. | 250/281 |
| 5,726,448 | A | | 3/1998 | Smith et al. | |
| 5,734,162 | A | | 3/1998 | Dowell | |
| 5,739,530 | A | | 4/1998 | Franzen et al. | |
| 5,747,801 | A | | 5/1998 | Quarmby et al. | |
| 5,756,993 | A | | 5/1998 | Yoshinari et al. | |
| 5,756,996 | A | | 5/1998 | Bier et al. | |
| 5,763,878 | A | | 6/1998 | Franzen | |
| 5,767,512 | A | | 6/1998 | Eiden et al. | |
| 5,777,214 | A | | 7/1998 | Thompson et al. | |
| 5,789,747 | A | | 8/1998 | Kato et al. | |
| 5,793,038 | A | | 8/1998 | Buttrill, Jr. | |
| 5,793,091 | A | | 8/1998 | Devoe | |
| 5,796,100 | A | | 8/1998 | Palermo | |
| 5,811,800 | A | | 9/1998 | Franzen et al. | |
| 5,818,055 | A | | 10/1998 | Franzen | |
| 5,825,026 | A | | 10/1998 | Baykut | |
| 5,847,386 | A | | 12/1998 | Thomson et al. | |
| 5,852,294 | A | | 12/1998 | Gulcicek et al. | |
| 5,859,433 | A | | 1/1999 | Franzen | |
| 5,864,136 | A | | 1/1999 | Kelley et al. | |
| 5,880,466 | A | | 3/1999 | Benner | |
| 5,886,346 | A | | 3/1999 | Makarov | |
| 5,900,481 | A | | 5/1999 | Lough et al. | |
| 5,903,003 | A | | 5/1999 | Schubert et al. | |
| 5,905,258 | A | | 5/1999 | Clemmer et al. | |
| 5,928,731 | A | | 7/1999 | Yanagida et al. | |
| 5,936,241 | A | | 8/1999 | Franzen et al. | |
| 5,962,851 | A | | 10/1999 | Whitehouse et al. | |
| 5,994,697 | A | | 11/1999 | Kato | |
| 6,005,245 | A | | 12/1999 | Sakairi et al. | |
| 6,011,259 | A | | 1/2000 | Whitehouse et al. | |
| 6,011,260 | A | | 1/2000 | Takada et al. | |

6,015,972 A 1/2000 Hager
6,020,586 A 2/2000 Dresch et al.
6,040,575 A 3/2000 Whitehouse et al.
6,060,706 A 5/2000 Nabeshima et al.
6,069,355 A 5/2000 Mordehai
6,075,243 A 6/2000 Nabeshima et al.
6,075,244 A * 6/2000 Baba et al. ..... 250/292
6,087,658 A 7/2000 Kawato
6,107,623 A 8/2000 Bateman et al.
6,107,625 A 8/2000 Park
6,121,607 A 9/2000 Whitehouse et al.
6,121,610 A 9/2000 Yoshinari et al.
6,124,591 A 9/2000 Schwartz et al.
6,124,592 A 9/2000 Spangler
RE36,906 E 10/2000 Franzen et al.
6,140,641 A 10/2000 Yoshinari et al.
6,147,348 A 11/2000 Quarmby et al.
6,156,527 A 12/2000 Schmidt et al.
6,157,030 A 12/2000 Sakairi et al.
6,157,031 A 12/2000 Prestage
6,177,668 B1 1/2001 Hager
6,180,941 B1 1/2001 Takada et al.
6,188,066 B1 2/2001 Whitehouse et al.
6,190,316 B1 2/2001 Hirabayashi et al.
6,194,716 B1 2/2001 Takada et al.
6,196,889 B1 3/2001 Mensinger
6,204,500 B1 3/2001 Whitehouse et al.
6,211,516 B1 4/2001 Syage et al.
6,222,185 B1 4/2001 Speakman et al.
6,259,091 B1 7/2001 Eiden et al.
6,276,618 B1 8/2001 Yanagida et al.
6,291,820 B1 9/2001 Hamza et al.
6,295,860 B1 10/2001 Sakairi et al.
6,297,500 B1 10/2001 Franzen et al.
6,316,769 B2 11/2001 Takada et al.
6,323,482 B1 11/2001 Clemmer et al.
6,326,615 B1 12/2001 Syage et al.
6,329,146 B1 12/2001 Crooke et al.
6,331,702 B1 12/2001 Krutchinsky et al.
6,342,393 B1 1/2002 Hofstadler et al.
6,344,646 B1 2/2002 Kato
6,379,970 B1 4/2002 Liebler et al.
6,380,666 B1 4/2002 Kawato
6,391,649 B1 5/2002 Chait et al.
6,392,225 B1 5/2002 Schwartz et al.
6,392,226 B1 5/2002 Takada et al.
6,403,952 B2 6/2002 Whitehouse et al.
6,403,953 B2 6/2002 Whitehouse et al.
6,403,955 B1 6/2002 Senko
6,414,306 B1 7/2002 Mayer-Posner et al.
6,414,331 B1 7/2002 Smith et al.
6,423,965 B1 7/2002 Hashimoto et al.
6,428,956 B1 8/2002 Crooke et al.
6,465,779 B1 10/2002 Takada et al.
6,469,298 B1 10/2002 Ramsey et al.
6,483,108 B1 11/2002 Sakairi
6,483,109 B1 11/2002 Reinhold et al.
6,483,244 B1 11/2002 Kawato et al.
6,489,609 B1 12/2002 Baba et al.
6,498,342 B1 12/2002 Clemmer
6,504,148 B1 1/2003 Hager
6,507,019 B2 1/2003 Chernushevich et al.
6,515,279 B1 2/2003 Baykut
6,515,280 B1 2/2003 Baykut
6,534,764 B1 3/2003 Verentchikov et al.
6,538,399 B1 3/2003 Shimoi et al.
6,541,769 B1 4/2003 Takada et al.
6,545,268 B1 4/2003 Verentchikov et al.
6,555,814 B1 4/2003 Baykut et al.
6,559,441 B2 5/2003 Clemmer
6,559,443 B2 5/2003 Shiokawa et al.
6,566,651 B2 5/2003 Baba et al.
6,570,151 B1 * 5/2003 Grosshans et al. ..... 250/282
6,571,649 B2 6/2003 Sakairi et al.
6,573,495 B2 6/2003 Senko
6,583,409 B2 6/2003 Kato
6,590,203 B2 7/2003 Kato
6,596,989 B2 7/2003 Kato
6,596,990 B2 7/2003 Kasten et al.
6,600,155 B1 7/2003 Andrien, Jr. et al.
6,608,303 B2 8/2003 Amy et al.
6,610,976 B2 8/2003 Chait et al.
6,621,077 B1 9/2003 Guevremont et al.
6,624,408 B1 9/2003 Franzen
6,624,411 B2 9/2003 Umemura
6,627,875 B2 9/2003 Afeyan et al.
6,627,876 B2 9/2003 Hager
6,629,040 B1 9/2003 Goodlett et al.
6,633,033 B2 10/2003 Yoshinari et al.
6,635,868 B2 10/2003 Shiokawa et al.
6,649,907 B2 11/2003 Ebeling et al.
6,649,911 B2 11/2003 Kawato
6,653,076 B1 11/2003 Franza, Jr. et al.
6,653,622 B2 11/2003 Franzen
6,653,627 B2 11/2003 Guevremont et al.
6,670,194 B1 12/2003 Aebersold et al.
6,670,606 B2 12/2003 Verentchikov et al.
6,674,067 B2 1/2004 Grosshans et al.
6,674,071 B2 1/2004 Franzen et al.
6,677,582 B2 1/2004 Yamada et al.
6,683,301 B2 1/2004 Whitehouse et al.
6,690,004 B2 2/2004 Miller et al.
6,690,005 B2 2/2004 Jenkins et al.
6,703,607 B2 3/2004 Stott et al.
6,703,609 B2 3/2004 Guevremont et al.
6,707,033 B2 3/2004 Okumura et al.
6,710,334 B1 3/2004 Twerenbold
6,710,336 B2 3/2004 Wells
6,717,155 B1 4/2004 Zschornack et al.
6,720,554 B2 4/2004 Hager
6,730,903 B2 * 5/2004 Kawato ..... 250/292
6,737,640 B2 5/2004 Kato
6,744,042 B2 6/2004 Zajfman et al.
6,745,134 B2 6/2004 Kobayashi et al.
6,753,523 B1 6/2004 Whitehouse et al.
6,759,652 B2 7/2004 Yoshinari et al.
6,762,406 B2 7/2004 Cooks et al.
6,765,198 B2 7/2004 Jenkins et al.
6,770,871 B1 8/2004 Wang et al.
6,770,872 B2 8/2004 Bateman et al.
6,770,875 B1 8/2004 Guevremont et al.
6,774,360 B2 8/2004 Guevremont et al.
6,777,671 B2 8/2004 Doroshenko
6,777,673 B2 8/2004 Chang et al.
6,784,421 B2 8/2004 Park
6,787,760 B2 9/2004 Belov et al.
6,787,767 B2 9/2004 Kato
6,791,078 B2 9/2004 Giles et al.
6,794,640 B2 9/2004 Bateman et al.
6,794,641 B2 9/2004 Bateman et al.
6,794,642 B2 9/2004 Bateman et al.
6,797,949 B2 9/2004 Hashimoto et al.
6,800,851 B1 10/2004 Zubarev et al.
6,803,569 B2 10/2004 Tsybin et al.
6,809,318 B2 10/2004 Krutchinsky et al.
6,815,673 B2 11/2004 Plomley et al.
6,822,224 B2 11/2004 Guevremont
6,825,461 B2 11/2004 Guevremont et al.
6,828,551 B2 12/2004 Kato
6,831,275 B2 12/2004 Franzen et al.
6,833,544 B1 12/2004 Campbell et al.
6,838,666 B2 1/2005 Ouyang et al.
6,844,547 B2 1/2005 Syka
6,847,037 B2 1/2005 Umemura
6,852,971 B2 2/2005 Baba et al.
6,858,840 B2 2/2005 Berkout et al.
6,861,644 B2 3/2005 Miseki
6,867,414 B2 3/2005 Buttrill, Jr.
6,870,159 B2 3/2005 Kawato
6,872,938 B2 3/2005 Makarov et al.
6,872,941 B1 3/2005 Whitehouse et al.
6,875,980 B2 4/2005 Bateman et al.
6,878,932 B1 4/2005 Kroska
6,888,133 B2 5/2005 Wells et al.
6,888,134 B2 5/2005 Hashimoto et al.
6,894,276 B1 5/2005 Takada et al.
6,897,438 B2 5/2005 Soudakov et al.
6,897,439 B1 5/2005 Whitehouse et al.

| | | | | |
|---|---|---|---|---|
| 6,900,430 | B2 | 5/2005 | Okumura et al. | |
| 6,900,433 | B2 | 5/2005 | Ding | |
| 6,903,331 | B2 | 6/2005 | Bateman et al. | |
| 6,906,319 | B2 | 6/2005 | Hoyes | |
| 6,906,324 | B1 | 6/2005 | Wang et al. | |
| 6,911,651 | B2 | 6/2005 | Senko et al. | |
| 6,914,242 | B2 | 7/2005 | Mordehai | |
| 6,933,498 | B1 | 8/2005 | Whitten et al. | |
| 6,949,743 | B1 | 9/2005 | Schwartz | |
| 6,953,929 | B2 | 10/2005 | Kato | |
| 6,958,473 | B2 | 10/2005 | Belov et al. | |
| 6,960,760 | B2 | 11/2005 | Bateman et al. | |
| 6,972,408 | B1 | 12/2005 | Reilly | |
| 6,977,373 | B2 | 12/2005 | Yoshinari et al. | |
| 6,977,374 | B2 * | 12/2005 | Kawato | 250/292 |
| 6,982,413 | B2 | 1/2006 | Knecht et al. | |
| 6,982,415 | B2 | 1/2006 | Kovtoun | |
| 6,987,261 | B2 | 1/2006 | Horning et al. | |
| 6,989,533 | B2 | 1/2006 | Bellec et al. | |
| 6,995,364 | B2 | 2/2006 | Makarov et al. | |
| 6,995,366 | B2 | 2/2006 | Franzen | |
| 6,998,609 | B2 | 2/2006 | Makarov et al. | |
| 6,998,610 | B2 | 2/2006 | Wang | |
| 7,019,289 | B2 | 3/2006 | Wang | |
| 7,019,290 | B2 | 3/2006 | Hager et al. | |
| 7,022,981 | B2 | 4/2006 | Kato | |
| 7,026,610 | B2 | 4/2006 | Kato | |
| 7,026,613 | B2 | 4/2006 | Syka | |
| 7,045,797 | B2 | 5/2006 | Sudakov et al. | |
| 7,049,580 | B2 | 5/2006 | Londry et al. | |
| 7,064,319 | B2 | 6/2006 | Hashimoto et al. | |
| 7,071,467 | B2 | 7/2006 | Bateman et al. | |
| 7,075,069 | B2 | 7/2006 | Yoshinari et al. | |
| 7,078,685 | B2 | 7/2006 | Takada et al. | |
| 7,095,013 | B2 | 8/2006 | Bateman et al. | |
| 7,102,126 | B2 | 9/2006 | Bateman et al. | |
| 7,102,129 | B2 | 9/2006 | Schwartz | |
| 7,112,787 | B2 | 9/2006 | Mordehal | |
| 7,115,862 | B2 | 10/2006 | Nagai et al. | |
| 7,119,331 | B2 | 10/2006 | Chang et al. | |
| 7,129,478 | B2 | 10/2006 | Baba et al. | |
| 7,141,789 | B2 | 11/2006 | Douglas et al. | |
| 7,154,088 | B1 | 12/2006 | Blain et al. | |
| 7,157,698 | B2 | 1/2007 | Makarov et al. | |
| 7,161,141 | B2 | 1/2007 | Mimura et al. | |
| 7,161,142 | B1 | 1/2007 | Patterson et al. | |
| 7,170,051 | B2 | 1/2007 | Berkout et al. | |
| 7,176,456 | B2 * | 2/2007 | Kawato | 250/292 |
| 7,183,542 | B2 | 2/2007 | Mordehai | |
| 7,186,973 | B2 | 3/2007 | Terui et al. | |
| 7,208,726 | B2 | 4/2007 | Hidalgo et al. | |
| 7,211,792 | B2 | 5/2007 | Yamaguchi et al. | |
| 7,217,919 | B2 | 5/2007 | Boyle et al. | |
| 7,217,922 | B2 | 5/2007 | Jachowski et al. | |
| 7,227,137 | B2 | 6/2007 | Londry et al. | |
| 7,227,138 | B2 | 6/2007 | Lee et al. | |
| 7,250,600 | B2 | 7/2007 | Yamaguchi | |
| 7,270,020 | B2 | 9/2007 | Gregory et al. | |
| 7,279,681 | B2 | 10/2007 | Li et al. | |
| 7,294,832 | B2 | 11/2007 | Wells et al. | |
| 7,297,939 | B2 | 11/2007 | Bateman et al. | |
| 7,323,683 | B2 | 1/2008 | Krutchinsky et al. | |
| 7,329,866 | B2 | 2/2008 | Wang | |
| 7,361,890 | B2 | 4/2008 | Patterson | |
| 7,375,320 | B2 | 5/2008 | Lee et al. | |
| 7,423,262 | B2 | 9/2008 | Mordehai et al. | |
| 7,446,310 | B2 | 11/2008 | Kovtoun | |
| 7,449,686 | B2 | 11/2008 | Wang et al. | |
| 7,456,389 | B2 | 11/2008 | Kovtoun | |
| 7,582,864 | B2 | 9/2009 | Verentchikov | |
| 2002/0005479 | A1 | 1/2002 | Yoshinari | |
| 2003/0155502 | A1 | 8/2003 | Grosshans et al. | |
| 2004/0217285 | A1 | 11/2004 | Smith | |
| 2004/0238737 | A1 | 12/2004 | Hager | |
| 2006/0163472 | A1 | 7/2006 | Marquette | |
| 2006/0273251 | A1 | 12/2006 | Verbeck | |
| 2007/0069121 | A1 | 3/2007 | Mimura et al. | |
| 2007/0158545 | A1 | 7/2007 | Verentchikov | |
| 2008/0012657 | A1 | 1/2008 | Vaszari | |
| 2008/0017794 | A1 | 1/2008 | Verbeck | |
| 2008/0035842 | A1 | 2/2008 | Sudakov | |
| 2008/0128605 | A1 | 6/2008 | Well | |
| 2009/0146054 | A1 | 6/2009 | Rafferty | |
| 2009/0256070 | A1 | 10/2009 | Nagano et al. | |
| 2009/0261247 | A1 | 10/2009 | Cooks et al. | |

FOREIGN PATENT DOCUMENTS

| | | |
|---|---|---|
| GB | 676238 | 7/1952 |
| GB | 2100078 | 12/1982 |
| WO | WO0175935 A1 | 10/2001 |
| WO | WO03/067627 | 8/2003 |

OTHER PUBLICATIONS

"Quadrupole ion trap," Wikipedia, the free encyclopedia, downloaded on Jul. 16, 2007 from http://en.wikipedia.org/wiki/Quadrupole_ion-trap.

Angulo, Luis, "Electronic SPDT controls two PCs," Sep. 2, 1999, www.ednmag.com, pp. 136-137.

Benilan, Marie-Noelle et al., "Ion Confinement by a Radiofrequency Electrical Field in a Cylindrical Trap," International Journal of Mass Spectrometry and Ion Physics, 11 (1973), pp. 421-423.

Ciasci, Ioan, "Charge Pump Converts $V_{IN}$ to $\pm V_{OUT}$," Sep. 2, 1999, www.ednmag.com, p. 134.

Harris, William et al., "Detection of Chemical Warfare-Related Species on Complex Aerosol Particles Deposited on Surfaces Using an Ion Trap-Based Aerosol Mass Spectrometer," Anal. Chem. 2007, 79 (6), pp. 2354-2358.

Harris, William et al. "MALDI of Individual Biomolecule-Containing Airborne Particles in an Ion Trap Mass Spectrometer," Anal. Chem. 2005, 77 (13), pp. 4042-4050.

Hoffart, Fran, "Li-ion battery charger adapts to different chemistries," Sep. 2, 1999, www.ednmag.com, pp. 146.

Jonscher, Karen R. et al., "Matrix-assisted Lasser Desorption Ionization/Quadrupole Ion Trap Mass Spectrometry of Peptides," The Journal of Biological Chemistry, 1997 vol. 272, No. 3, Jan. 17 issue, pp. 1735-1741.

Jonscher, Karen R. et al., "The Whys and Wherefores of Quadrupole Ion Trap Mass Spectrometry," Ion Trap Mass Spectrometry, 1996, Retrieved on Feb. 13, 2009 from the Internet at: http://www.abrf.org/ABRFNews/1996/September1996/sep96iontrap.html.

Koizumi, Hideya, et al., "Trapping of Intact, Singly-Charged, Bovine Serum Albumin Ions Injected from the Atmosphere with a 10-cm Diameter, Frequency-Adjusted Linear Quadrupole Ion Trap," J. Am Soc Mass Spectrom 2008, 19, pp. 1942-1947.

Lazar, Alexandru et al., "Laser Desorption/in Situ Chemical Ionization Aerosol Mass Spectrometry for Monitoring Tributyl Phosphate on the Surface of Environmental Particles," Anal. Chem. 2000, 72 99), pp. 2142-2147.

Lazar, Alexandru et al., "Laser desorption/ionization coupled to tandem mass spectrometry for real-time monitoring of paraquat on the surface of environmental particles," Rapid Commun. Mass Spectrom, 2000, 14, pp. 1523-1529.

Londry, F.A. et al., "Mass selective axial ion ejection from a linear quadrupole ion trap," J Am Soc of Mass Spectrom., vol. 14, Issue 10, Oct. 2003, pp. 1130-1147 http://www.sciencedirect.com/science?_ob=ArticleURL&_udi=B6TH2-497HFH6-3&_user=10&_rdoc=1&_fmt=&_orig=search&_sort=d&view=c&_version=1&_urlVersion=0&_userid=10&md5=7c6211b59a632a920ef6ca9add1bdd0d.

McCarthy, Mary, "DDS device provides amplitude modulation," Sep. 2, 1999, www.ednmag.com pp. 133-134.

Moxom, Jeremy et al., "Analysis of Volatile Organic Compounds in Air with a Micro Ion Trap Mass Analyzer,," Anal. Chem., 2003, 75 (15),3739-3743; DOI: 10.1021/ac034043k Publication date Jun. 19, 2003.

Moxom, Jeremy et al., "Double resonance ejection in a micro ion trap mass spectrometer," Rapid Commun. Mass Spectrom. 2002, 16: pp. 755-760.

Moxom, Jeremy et al., "Sample pressure effects in a micro ion trap mass spectrometer," RCM Letter to the Editor, Rapid Commun. Mass Spectrom., 2004, 18: pp. 721-723.

Palasek, Thomas A., "An RF Oscillator for Rocket-Borne and Balloon-Borne Quadrupole Mass Spectrometers," Northeastern University Electronics Research Lab, Scientific Report No. 2, Sep. 10, 1979, Thesis paper reproduced by National Technical Information Service (NTIS).
Pau, S. et al., "Microfabricated Quadrupole Ion Trap for Mass Spectrometer Applications," The American Physical Society, Physical Review Letters, 2006; pp. 120801-1 to 120801-4.
Pau, S. et al., "Planar Geometry for Trapping and Separating Ions and Charging Particles," Anal. Chem., 2007, 79 (17), pp. 6857-6861.
Ramirez, D. et al., "GMR Sensors Manage Batteries," Sep. 2, 1999, www.ednmag.com, pp. 138-140.
Sherman, David, "Program turns PC sound card into a function generator," Sep. 2, 1999, www.ednmag.com, pp. 142-144.
Tabert, Amy et al., "Co-occurrence of Boundary and Resonance Ejection in a Multiplexed Rectilinear Ion Trap Mass Spectrometer," J. Am Soc Mass Spectrom. 2005, 17, pp. 56-59.
Whitten, William B. et al., "High-pressure ion trap mass spectrometry," Rapid Commun. Mass Spectrom., 2004, 18: pp. 1749-1752.
Wolczko, Andrzej, "Driver thermally compensates LED," Sep. 2, 1999, www.ednmag.com, pp. 140-142.
Written Opinion of the International Preliminary Examining Authority for Application No. PCT/US2009/045283, Jul. 13, 2010, 5 pages.
Horowitz, Hill, "The Art of Electronics," 1980, Cambridge University Press, Cambridge, UK, XP002558161, pp. 24-35.
International Search Report and the Written Opinion for Application No. PCT/US2009/045283, Dec. 15, 2009, 14 pages.
International Search Report and the Written Opinion for Application No. PCT/US2008/086241, Feb. 9, 2009, 7 pages.
International Preliminary Report on Patentability for Application No. PCT/US2009/045283, Sep. 16, 2010, 9 pages.
Written Opinion of the International Preliminary Examining Authority for Application No. PCT/US2008/086241, Sep. 17, 2010, 5 pages.
European Search Report for Application No. 08859432.0, Jul. 22, 2011, 4 pages.
First Office Action for Application No. 200880126515.9, Oct. 10, 2011, 7 pages.
International Preliminary Report on Patentability for Application No. PCT/US2008/086241, Dec. 6, 2011, 13 pages.

* cited by examiner

END CAP VOLTAGE CONTROL OF ION TRAPS

CROSS-REFERENCE TO RELATED APPLICATIONS

This application claims priority to U.S. provisional application Ser. No. 61/012,660 filed on Dec. 10, 2007, which is hereby incorporated by reference herein.

TECHNICAL FIELD

This invention relates to ion traps, ion trap mass spectrometers, and more particularly to control signal generation for an ion trap used in mass spectrometric chemical analysis.

BACKGROUND

Using an ion trap is one method of performing mass spectrometric chemical analysis. An ion trap dynamically traps ions from a measurement sample using a dynamic electric field generated by a driving signal or signals. The ions are selectively ejected corresponding to their mass-charge ratio (mass (m)/charge (z)) by changing the characteristics of the electric field (e.g., amplitude, frequency, etc.) that is trapping them. More background information concerning ion trap mass spectrometry may be found in "Practical Aspects of Ion Trap Mass Spectrometry," by Raymond E. March et al., which is hereby incorporated by reference herein.

Ramsey et al. in U.S. Pat. Nos. 6,469,298 and 6,933,498 (hereafter the "Ramsey patents") disclosed a sub-millimeter ion trap and ion trap array for mass spectrometric chemical analysis of ions. The ion trap described in U.S. Pat. No. 6,469,298 includes a central electrode having an aperture; a pair of insulators, each having an aperture; a pair of end cap electrodes, each having an aperture; a first electronic signal source coupled to the central electrode; and a second electronic signal source coupled to the end cap electrodes. The central electrode, insulators, and end cap electrodes are united in a sandwich construction where their respective apertures are coaxially aligned and symmetric about an axis to form a partially enclosed cavity having an effective radius $R_0$ and an effective length $2Z_0$, wherein $R_0$ and/or $Z_0$ are less than 1.0 millimeter (mm), and a ratio $Z_0/R_0$ is greater than 0.83.

George Safford presents a "Method of Mass Analyzing a Sample by use of a Quadrupole Ion Trap" in U.S. Pat. No. 4,540,884, which describes a complete ion trap based mass spectrometer system.

An ion trap internally traps ions in a dynamic quadrupole field created by the electrical signal applied to the center electrode relative to the end cap voltages (or signals). Simply, a signal of constant frequency is applied to the center electrode and the two end cap electrodes are maintained at a static zero volts. The amplitude of the center electrode signal is ramped up linearly in order to selectively destabilize different masses of ions held within the ion trap. This amplitude ejection configuration does not result in optimal performance or resolution and may actually result in double peaks in the output spectra. This amplitude ejection method may be improved upon by applying a second signal to one end cap of the ion trap. This second signal causes an axial excitation that results in the resonance ejection of ions from the ion trap when the ions' secular frequency of oscillation within the trap matches the end cap excitation frequency. Resonance ejection causes the ion to be ejected from the ion trap at a secular resonance point corresponding to a stability diagram beta value of less than one. A beta value of less than one is traditionally obtained by applying an end cap (axial) frequency that is a factor of 1/n times the center electrode frequency, where n is typically an integer greater than or equal to 2.

Moxom et al. in "Double Resonance Ejection in a Micro Ion Trap Mass Spectrometer," Rapid Communication Mass Spectrometry 2002, 16: pages 755-760, describe increased mass spectroscopic resolution in the Ramsey patents device by the use of differential voltages on the end caps. Testing demonstrated that applying a differential voltage between end caps promotes resonance ejection at lower voltages than the earlier Ramsey patents and eliminates the "peak doubling" effect also inherent in the earlier Ramsey patents. This device requires a minimum of two separate voltage supplies: one that must control the radio frequency (RF) voltage signal applied to the central electrode and at least one that must control the end cap electrode (the first end cap electrode is grounded, or at zero volts, relative to the rest of the system).

Although performance of an ion trap may be increased by the application of an additional signal applied to one of the ion trap's end caps, doing so increases the complexity of the system. The second signal requires electronics in order to generate and drive the signal into the end cap of the ion trap. This signal optimally needs to be synchronized with the center electrode signal. These additional electronics increase the size, weight, and power consumption of the mass spectrometer system. This could be very important in a portable mass spectrometer application.

SUMMARY

An ion trap comprises a conductive ring-shaped central electrode having a first aperture extending from a first open end to a second open end. A signal source generates a trap signal having at least an alternating current (AC) component between a first and second terminal. The first terminal is coupled to the central electrode and the second terminal is coupled to a reference voltage potential. A conductive first electrode end cap is disposed adjacent to the first open end of the central electrode and coupled to the reference voltage potential. A first intrinsic capacitance is formed between a surface of the first electrode end cap and a surface of the first open end of the central electrode.

A conductive second electrode end cap is disposed adjacent to the second open end of the central electrode and coupled to the reference voltage potential with a first electrical circuit. A second intrinsic capacitance is formed between a surface of the second electrode end cap and a surface of the second open end of the central electrode. An excitation voltage that is a fractional part of the trap signal is impressed on the second end cap in response to a voltage division of the trap signal by the second intrinsic capacitance and an impedance of the first electrical circuit.

In one embodiment, the electrical circuit is a parallel circuit of a capacitor and a resistor. The resistor is sized to prevent the second end cap from charging thereby preventing possible charge build up or uncontrolled voltage drift. The resistor is also sized to have an impedance much greater than an impedance of the capacitor at an operating frequency of the trap signal. In this manner, the excitation voltage division remains substantially constant with changing excitation voltage frequency, and the excitation voltage is substantially in phase with the signal impressed on the central electrode.

Embodiments herein are directed to generation of a trap signal and impressing a fractional part of the trap signal on the second end cap of an ion trap used for mass spectrometric chemical analysis in order to increase performance without significant added complexity, cost, or power consumption.

Embodiments operate to improve spectral resolution and eliminate double peaks in the output spectra that could otherwise be present.

Other embodiments employ switching circuits that may be employed to connect the end cap electrodes to different circuits of passive components and/or voltages at different times. In some embodiments, the electrical circuit may employ passive components that include inductors, transformers, or other passive circuit elements used to change the characteristics (such as phase) of the second end cap signal.

Embodiments are directed to improving ion trap performance by applying an additional excitation voltage across the end caps of an ion trap. Unlike the typical resonance ejection technique, this excitation voltage has a frequency equal to the center electrode excitation frequency. The generation of this excitation voltage can be accomplished using only passive components without the need for an additional signal generator or signal driver.

The details of one or more embodiments are set forth in the accompanying drawings and the description below. Other features, objects, and advantages of the invention will be apparent from the description and drawings, and from the claims.

BRIEF DESCRIPTION OF DRAWINGS

Like reference symbols in the various drawings may indicate like elements.

DETAILED DESCRIPTION

Embodiments herein provide an electrical excitation for the end cap of an ion trap to improve ion trap operation. Embodiments provide a simple electrical circuit that derives the electrical excitation signal from the signal present on the center electrode of an ion trap.

In one embodiment, passive electrical components are used to apply a signal to the second end cap of an ion trap in order to increase performance. The added components serve to apply a percentage of the central electrode excitation signal to the second end cap. This results in an axial excitation within the ion trap that improves performance with negligible power loss, minimal complexity while having a minimum impact on system size. In some embodiments, the added components may cause an increase in the impedance seen at the central electrode due to the circuit configuration of the added components, which results in an actual reduction in overall system power consumption.

In embodiments, the frequency of the signal applied to the second end cap is the same as the frequency of the center electrode. The performance increase is afforded without performing conventional resonance ejection, since the frequency of the applied signal is equal to the frequency of the center electrode. Note that this method may be performed in tandem with conventional resonance ejection methods in order to optimize ion trap performance. This may be accomplished by additionally driving one or both end caps with a conventional resonance ejection signal source through a passive element(s) so that both the conventional resonance ejection signal and the previously described signal are simultaneously impressed upon the ion trap. One embodiment comprises applying a conventional resonance ejection signal to either end cap, and the previously described signal having the same frequency as the center electrode to the remaining end cap.

Some embodiments herein may not require retuning or adjustment when the frequency of operation is varied. Variable frequency operation without retuning is possible because the signal impressed on the second end cap is derived from the signal coupled to the central electrode through the use of a capacitive voltage divider that is substantially independent of frequency and depending only on actual capacitance values. This holds true as long as the resistance shunting the added capacitor is significantly larger than the impedance of the capacitor in the frequency range of operation.

Figure 3A:
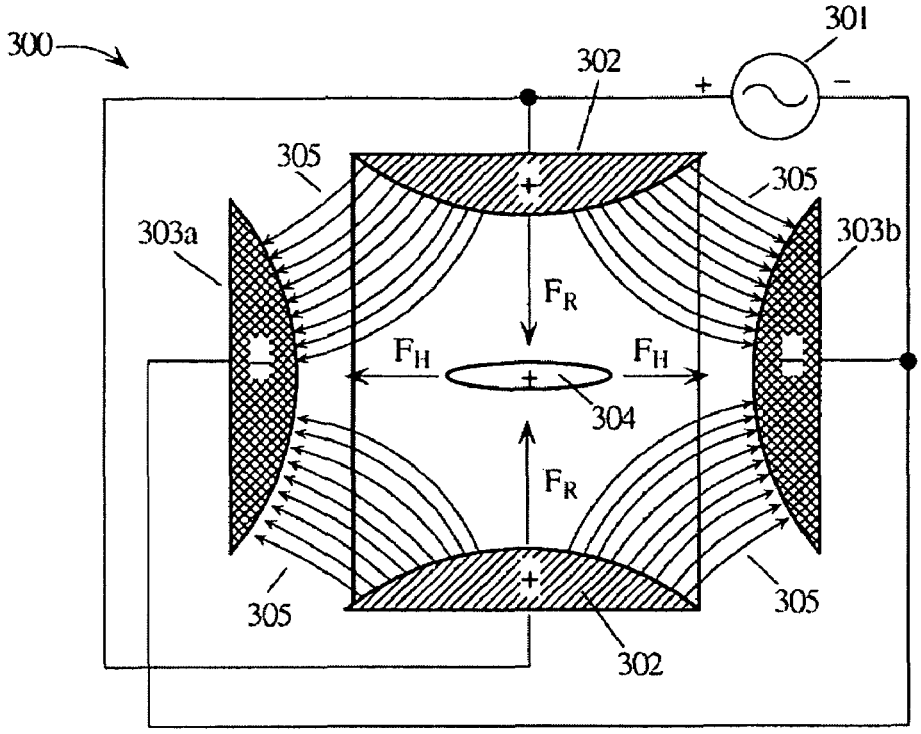
FIG. 3A (Prior Art)
FIG. 3A is a cross-section view illustrating a quadrupole ion trap during one polarity of an excitation source.
Figure 3B:
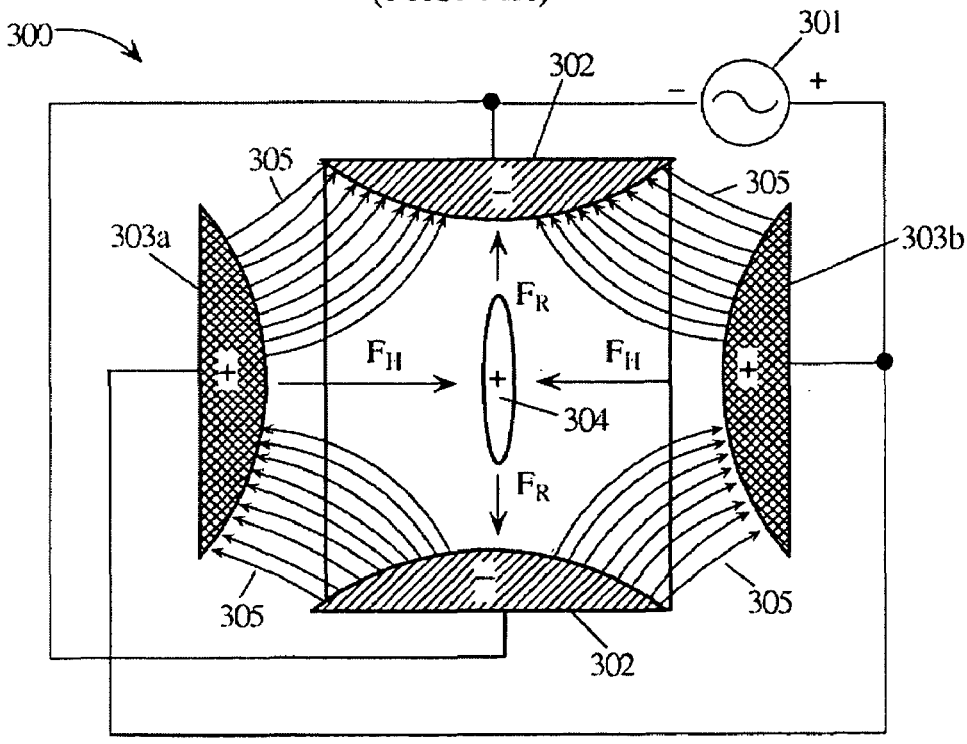
FIG. 3B (Prior Art)
FIG. 3B is a cross-section view illustrating a quadrupole ion trap during the other polarity of the excitation source.

FIGS. 3A and 3B illustrate a cross-section of a prior art quadrupole ion trap 300. The ion trap 300 comprises two hyperbolic metal electrodes (end caps) 303*a*, 303*b* and a hyperbolic ring electrode 302 disposed half-way between the end cap electrodes 303*a* and 303*b*. The positively charged ions 304 are trapped between these three electrodes by electric fields 305. Ring electrode 302 is electrically coupled to one terminal of a radio frequency (RF) AC voltage source 301. The second terminal of AC voltage source 301 is coupled to hyperbolic end cap electrodes 303*a* and 303*b*. As AC voltage source 301 alternates polarity, the electric field lines 305 alternate. The ions 304 within the ion trap 300 are confined by this dynamic quadrupole field as well as fractional higher order (hexapole, octapole, etc.) electric fields.

Figure 1:
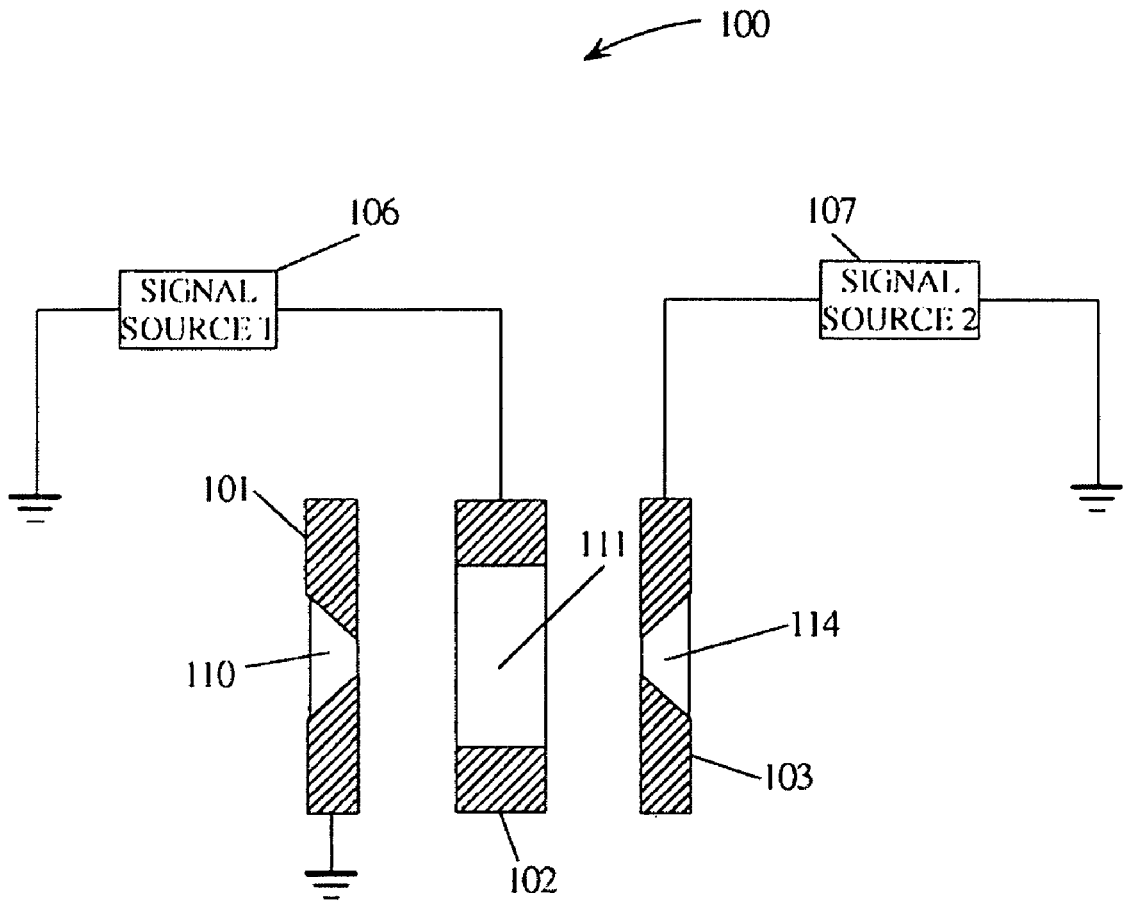
FIG. 1 (PRIOR ART)
FIG. 1 is a circuit block diagram of a prior art ion trap signal driving method showing two signal sources.

FIG. 1 is a schematic block diagram 100 illustrating cross-sections of electrodes coupled to a prior art signal driving method for an ion trap having two signal sources. The first ion trap electrode (end cap) 101 is connected to ground or zero volts. The ion trap central electrode 102 is driven by a first signal source 106. The second ion trap end cap 103 is driven by a second signal source 107. First end cap 101 has an aperture 110. Central electrode 102 is ring shaped with an aperture 111 and second end cap 103 has an aperture 114.

Figure 2:
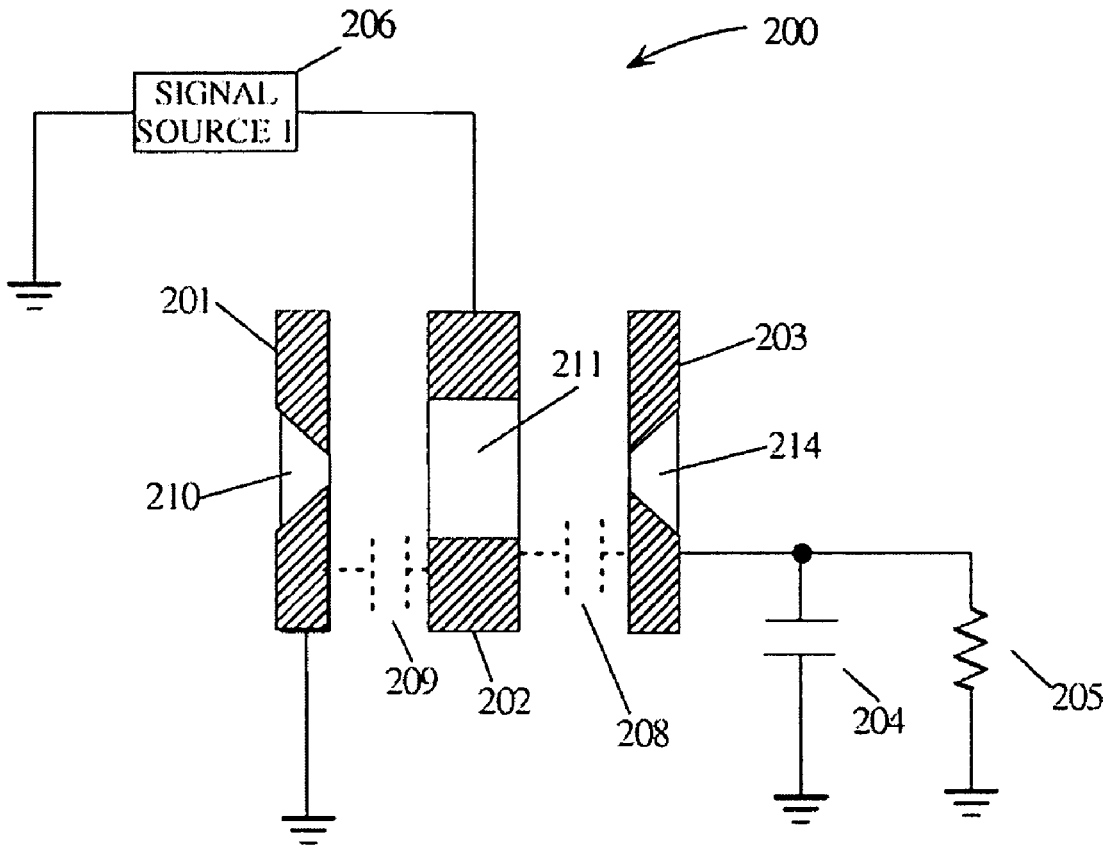
FIG. 2 is a circuit block diagram of one embodiment using a single signal source.

FIG. 2 is a schematic block diagram 200 illustrating cross-sections of electrodes according to one embodiment wherein an ion trap is actively driven by only one external signal source 206. First end cap 201 has an aperture 210, central electrode 202 has an aperture 211 and second end cap 203 has an aperture 214. The first ion trap end cap 201 is coupled to ground or zero volts, however, other embodiments may use other than zero volts. For example, in another embodiment the first end cap 201 may be connected to a variable DC voltage or other signal. The ion trap central electrode 202 is driven by signal source 206. The second ion trap end cap 203 is connected to zero volts by the parallel combination of a capacitor 204 and a resistor 205.

The embodiment illustrated in FIG. 2 operates in the following manner: an intrinsic capacitance 208 naturally exists between central electrode 202 and the second end cap 203. Capacitance 208 in series with the capacitance of capacitor 204 form a capacitive voltage divider thereby impressing a potential derived from signal source 206 at second end cap 203. When signal source 206 impresses a varying voltage on central electrode 202, a varying voltage of lesser amplitude is impressed upon the second end cap 203 through action of the capacitive voltage divider. Naturally, there exists a corresponding intrinsic capacitance between central electrode 202 and first end cap 201. According to one embodiment, a discrete resistor 205 is added between second end cap 203 and zero volts. Resistor 205 provides an electrical path that acts to prevent second end cap 203 from developing a floating DC potential that could cause voltage drift or excess charge build-up. In one embodiment, the value of resistor 205 is sized to be in the range of 1 to 10 Mega-ohms (MΩ) to ensure that the impedance of resistor 205 is much greater than the impedance of added capacitor 204 at an operating frequency of signal source 206. If the resistance value of resistor 205 is not much greater than the impedance of $C_A$ 204, then there will be a phase shift between the signal at central electrode 202 and signal impressed on second end cap 203 by the capacitive voltage divider. If the resistance value of resistor 205 not much greater than the impedance of $C_A$ 204, the amplitude of the signal impressed on second end cap 203 will vary as a function of frequency. Without resistor 205, the capacitive voltage divider ($C_S$ and $C_A$) is substantially independent of frequency. In one embodiment, the value of the added capacitor 204 is made variable so that it may be adjusted to have an optimized value for a given system characteristics.

Figure 4:
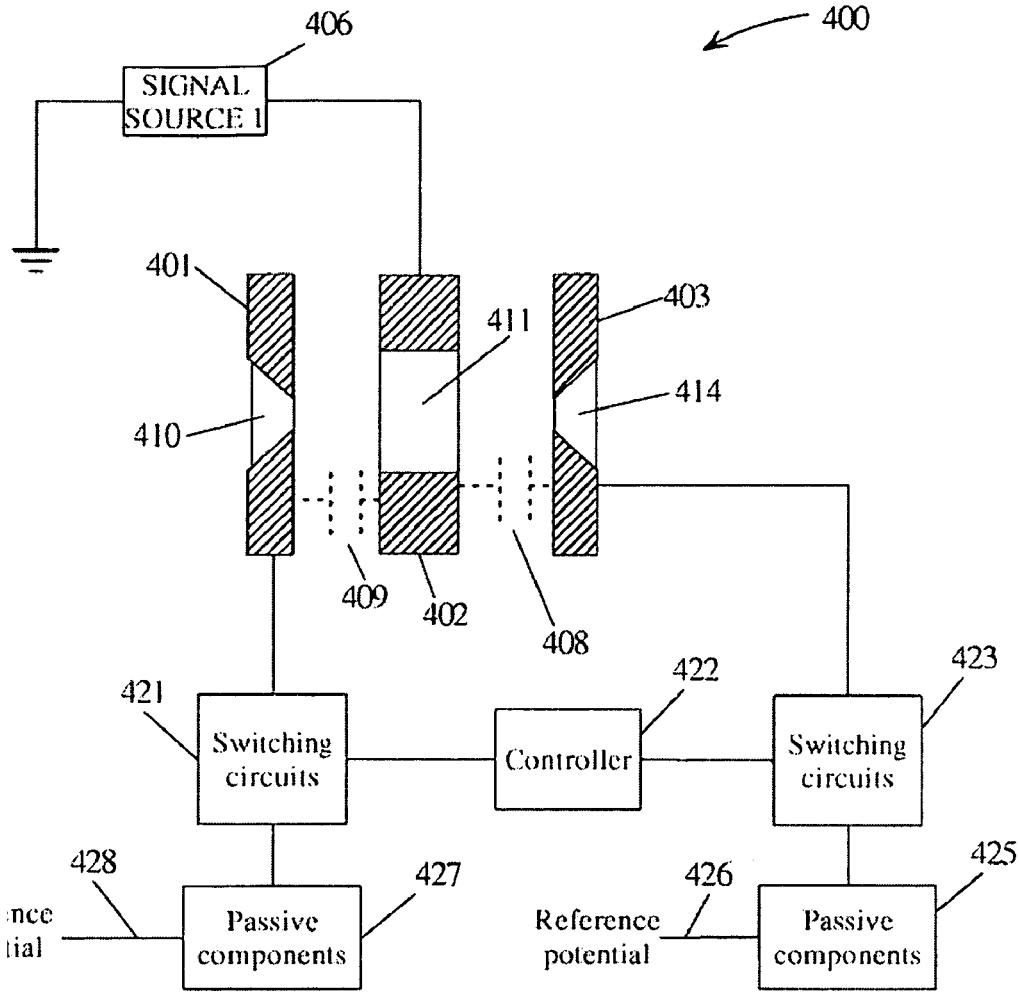
FIG. 4 is a circuit block diagram of another embodiment using a single signal source and switch circuits to couple passive components.

FIG. 4 is a schematic block diagram 400 illustrating cross-sections of electrodes according to one embodiment wherein an ion trap is actively driven by only one external signal source 406. Again, first end cap 401 has an aperture 410, central electrode 402 has an aperture 411 and second end cap 403 has an aperture 414. The first ion trap end cap 401 is coupled, in response to control signals from controller 422, to passive components 427 with switching circuits 421. Various components in passive components 427 may be coupled to reference voltage 428 which in some embodiments may be ground or zero volts. In another embodiment, the reference voltage 428 may be a DC or a variable voltage. The combination of switching circuits 421 and passive components 427 serve to control and modify the potential on first end cap 401 to improve the operation of the ion trap.

The second ion trap end cap 403 is coupled, in response to control signals from controller 422, to passive components 425 with switching circuits 423. Various components in passive components 425 may be coupled to reference voltage 426, which in some embodiments may be ground or zero volts. In another embodiment, the reference voltage 426 may be a DC or a variable voltage. The combination of switching circuits 423 and passive components 425 serve to control and modify the potential on second end cap 403 to improve the operation of the ion trap. Capacitances 408 and 409 combine with the passive components 425 and 427 to couple a portion of signal source 406 when switched in by switching circuits 423 and 421, respectively.

A number of embodiments of the invention have been described. Nevertheless, it will be understood that various modifications may be made without departing from the spirit and scope of the invention.

The invention claimed is:

1. An ion trap mass spectrometer comprising:

a conductive ring-shaped central electrode having a first aperture extending, from a first open end to a second open end;

a signal source generator configured to generate a trap signal having at least an alternating current (AC) component between a first and second terminal, wherein the first terminal is coupled to the central electrode and the second terminal is coupled to a reference voltage potential;

a conductive first undivided electrode end cap disposed adjacent to the first open end of the central electrode and coupled to a first DC reference voltage potential, wherein a first intrinsic capacitance is formed between a surface of the first undivided electrode end cap and a surface of the first open end of the central electrode; and a conductive second undivided electrode end cap disposed adjacent to the second open end of the central electrode and coupled to a second DC reference voltage potential with a first electrical circuit, wherein a second intrinsic capacitance is formed between a surface of the second undivided electrode end cap and a surface of the second open end of the central electrode, wherein a fractional part of the trap signal is impressed on the second undivided electrode end cap in response to a voltage division of the trap signal by the second intrinsic capacitance and an impedance of the first electrical circuit; and wherein the central electrode, the first undivided electrode end cap, and the second undivided electrode end cap together form a cylindrical ion trap; and wherein the first electrical circuit comprises a resistor having, an impedance in the range of 1 MΩ to 10 MΩ.

2. The ion trap mass spectrometer of claim 1, wherein the first electrical circuit comprises a capacitor in parallel with the resistor.

3. The ion trap mass spectrometer of claim 2, wherein the impedance of the resistor is greater than one fourth of an impedance of the capacitor at a frequency of the trap signal.

4. The ion trap mass spectrometer of claim 1, wherein the reference voltage potential is ground or zero volts.

5. The ion trap mass spectrometer of claim 1, wherein the reference voltage potential is an adjustable DC voltage.

6. The ion trap mass spectrometer of claim 1, wherein the capacitor is a variable capacitor adjustable to optimize an operating characteristic of the ion trap.

7. The ion trap mass spectrometer of claim 1, wherein the ion trap is a mass analyzer, and wherein the first DC reference voltage potential, the second DC reference voltage potential, or both are an adjustable DC voltage.

8. The ion trap mass spectrometer of claim 1, wherein the first and second DC reference voltage potentials are generated by corresponding DC voltage sources.

9. The ion trap mass spectrometer of claim 1, wherein the ion trap is configured to impress the fractional part of the trap signal only on the second undivided electrode end cap.

10. The ion trap mass spectrometer of claim 1, wherein the ion trap is configured to receive a resonance ejection signal.

11. The ion trap mass spectrometer of claim 1, wherein the first electrical circuit includes a capacitor, the resistor having an impedance greater than an impedance of the capacitor at the frequency of the trap signal such that the amplitude of the fractional part of the trap signal is substantially independent of the frequency of the trap signal.

12. The ion trap mass spectrometer of claim 1, wherein the first electrical circuit includes a capacitor, the resistor having an impedance greater than an impedance of the capacitor at the frequency of the trap signal such that the phase difference between the fractional part of the trap signal and the trap signal is substantially independent of the frequency of the trap signal.

13. The ion trap mass spectrometer of claim 1, wherein the ion trap is configured to impress a fractional part of the trap signal on both the first undivided electrode end cap and the second undivided electrode end cap.

14. The ion trap mass spectrometer of claim 1, further comprising a second electrical circuit coupled between the first undivided electrode end cap and the first DC reference voltage potential, wherein a fractional part of the trap signal is impressed on the first undivided electrode end cap in response to a voltage division of the trap signal by the first intrinsic capacitance and an impedance of the second electrical circuit.

* * * * *